US005937841A

United States Patent [19]

Summers et al.

[11] Patent Number: 5,937,841

[45] Date of Patent: Aug. 17, 1999

[54] WRIST STRAP CONNECTOR FOR A BOWSTRING RELEASE

[75] Inventors: Gregory E. Summers, 105 Overlink Ct., Lynchburg, Va. 24503; Randy Summers; Marc Rentz, both of Madison Heights, Va.

[73] Assignee: Gregory E. Summers, Lynchburg, Va.

[21] Appl. No.: 09/002,863

[22] Filed: Jan. 5, 1998

[51] Int. Cl.[6] ..... F41B 5/18

[52] U.S. Cl. ..... 124/35.2; 403/53

[58] Field of Search ..... 124/35.2; 403/53, 403/76, 78, 118, 119, 150, 164

[56] References Cited

U.S. PATENT DOCUMENTS

| | | | |
|---|---|---|---|
| 1,550,069 | 8/1925 | Goolsby et al. | 403/78 |
| 1,829,964 | 11/1931 | Randall | 403/78 X |
| 2,417,791 | 3/1947 | Tyszkiewicz . | |
| 2,466,243 | 4/1949 | Johnson | 403/78 X |
| 2,488,597 | 11/1949 | Konold | 124/35.2 |
| 2,637,311 | 5/1953 | Rose . | |
| 2,819,707 | 1/1958 | Kayfes et al. . | |
| 2,905,166 | 9/1959 | Niemeyer | 124/91 |
| 2,965,093 | 12/1960 | Arsenault . | |
| 2,977,952 | 4/1961 | Gabriel et al. . | |
| 3,847,133 | 11/1974 | Awiszus | 124/35.2 X |
| 4,086,904 | 5/1978 | Suski et al. | 124/90 |
| 4,134,369 | 1/1979 | Cook | 124/35.2 |
| 4,151,825 | 5/1979 | Cook . | |
| 4,282,851 | 8/1981 | Lyons . | |
| 4,509,497 | 4/1985 | Garvison | 124/35.2 |
| 4,539,968 | 9/1985 | Garvison | 124/35.2 |
| 4,620,523 | 11/1986 | Peck . | |
| 4,656,994 | 4/1987 | Jenks . | |
| 4,674,469 | 6/1987 | Peck . | |
| 4,691,638 | 9/1987 | Peck . | |
| 4,722,319 | 2/1988 | Brady . | |
| 4,791,908 | 12/1988 | Pellis . | |
| 4,881,516 | 11/1989 | Peck . | |
| 4,909,233 | 3/1990 | Stephenson | 124/91 |
| 4,926,835 | 5/1990 | Peck | 124/35.2 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,027,786 | 7/1991 | Peck | 124/35.2 |
| 5,070,854 | 12/1991 | Peck | 124/35.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,247,921 | 9/1993 | Todd | 124/35.2 |
| 5,263,466 | 11/1993 | Peck | 124/35.2 |
| 5,318,004 | 6/1994 | Peck | 124/35.2 |
| 5,359,983 | 11/1994 | Peck | 124/35.2 |
| 5,361,747 | 11/1994 | Laabs | 124/91 |
| 5,370,102 | 12/1994 | Peck | 124/35.2 |
| 5,615,662 | 4/1997 | Tentler et al. | 124/35.2 |
| 5,653,214 | 8/1997 | Lynn | 124/35.2 |
| 5,680,851 | 10/1997 | Summers | 124/35.2 |
| 5,685,286 | 11/1997 | Summers | 124/35.2 |

*Primary Examiner*—John A. Ricci
*Attorney, Agent, or Firm*—Nixon & Vanderhye P.C.

[57] ABSTRACT

A connector for a bowstring release wrist strap includes a barrel portion having a first end adapted to receive a fastener component mounted on the bowstring release, and a second end receiving a slidable and axially adjustable link rod, the link rod rotatable relative to the barrel portion and having a distal free end adapted for connection to a wrist strap.

16 Claims, 7 Drawing Sheets

Fig. 6
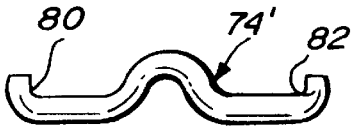
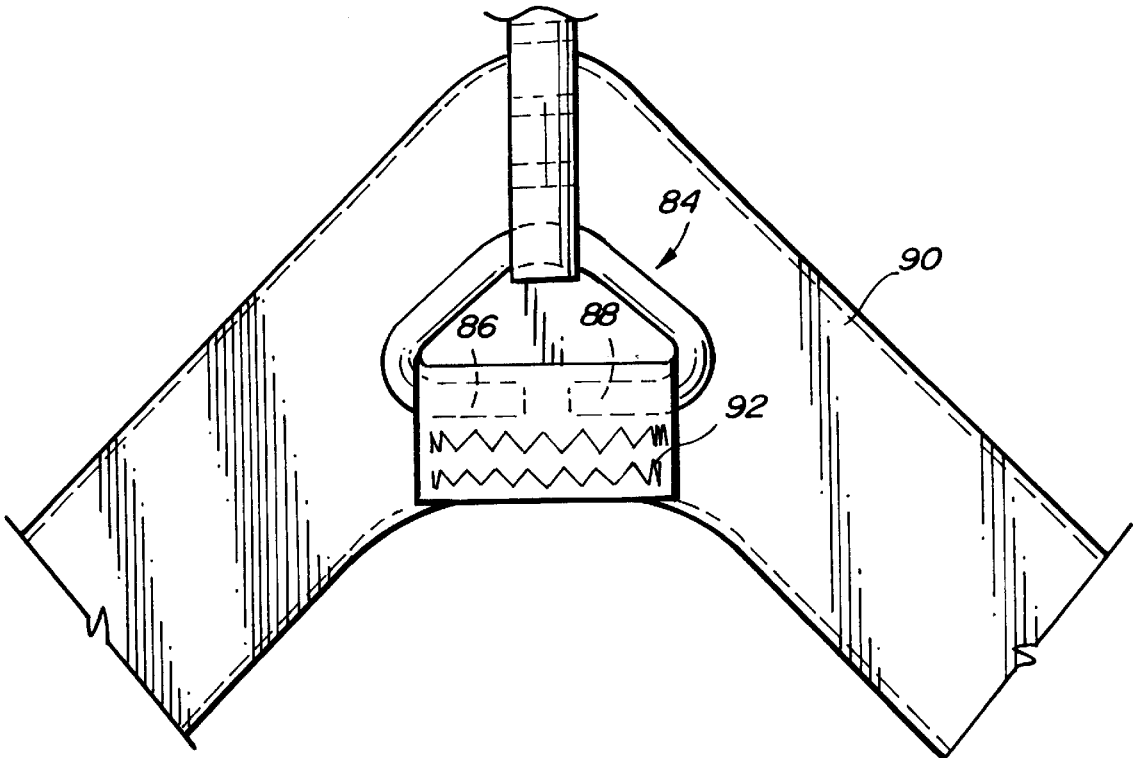
Fig. 7

WRIST STRAP CONNECTOR FOR A BOWSTRING RELEASE

TECHNICAL FIELD

This invention relates to bowstring release devices and, more specifically, to a wrist strap connector for a bowstring release device.

BACKGROUND AND SUMMARY OF THE INVENTION

Various release devices are utilized in archery to assist the archer in pulling a bowstring to a fully drawn position and then releasing the bowstring to fire the arrow. Many of these devices include mechanical grippers which engage the bowstring directly, or which engage nock elements mounted on the bowstring. Other devices use rope looped about the bowstring as the release mechanism.

It is also known to use wrist straps connected to the release devices to enhance control and accuracy of the release device. Examples of such wrist straps may be found in U.S. Pat. Nos. 5,020,508; 4,981,128; 4,791,908; and 4,509,497.

The present invention relates to an improved wrist strap and associated connector which provides several degrees of freedom of movement for the release device relative to the wrist strap.

The connector by which the release device is connected to the wrist strap in accordance with the present invention eliminates torque between the release body and the connector/wrist strap assembly. At the same time, the connection between the connector itself and the wrist strap allows for complete mobility between the release and the wrist strap, permitting the release to lay back on the users arm when not in use.

In a first exemplary embodiment of the invention, a connector and associated wrist strap assembly includes a connector barrel having a threaded aperture at the forward end thereof which is adapted to receive a threaded fastener from a link pin mounted in a rearward portion of the release device. The link pin may comprise a generally cylindrical or disk-shaped member transversely bored and counterbored to receive the head of a threaded screw. The threaded shank portion of the screw extends rearwardly of the link pin and is adapted to be received in the threaded aperture at the forward end of the connector barrel. The link pin may rotate about its own transverse center axis, while the screw fastener is free to rotate within the link pin about its own mutually perpendicular axis. Set screws are used to lock the screw fastener to the connector barrel, so that the connector barrel is also free to rotate with the screw fastener relative to the link pin and the release. The screw fastener can be threaded into the connector barrel to the desired extent prior to locking in place with the set screws, thereby also affording a degree of axial adjustability between the release device and the connector.

A rearward portion of the barrel-shaped connector is formed with a relatively smooth bore intersected by a pair of transversely oriented threaded apertures in generally opposed relationship. The rearward end of the barrel connector has a round opening which is adapted to receive an adjustable link rod in telescoping relationship. The link rod is also generally cylindrical in shape and adapted to slide in opposite directions within the barrel. The link rod is formed with one and preferably two or more transverse holes which are alignable with the transverse holes in the barrel. In other words, the link rod can also be adjusted axially within the barrel connector, and locked in the desired position by set screws extending through the transverse holes in the barrel, the set screws extending at least partially into the chosen hole in the link rod. This arrangement provides a further degree of axial adjustability. The rearwardmost end of the link rod is formed with a rearwardly extending tongue having a transverse hole adapted to connect with a strap link sewn into the wrist strap. The release and barrel connector are thus free to slide about and pivot about the strap link on the strap itself, thereby affording several additional degrees of freedom of movement for the release device and connector relative to the wrist strap.

Other embodiments of the invention adapt the connector for use with different release devices. A variation in the wrist strap link design is also disclosed herein, which further enhances the ability of the connector barrel to slide on the link.

Accordingly, in its broader aspects, the present invention relates to a connector for a bowstring release wrist strap comprising:

a barrel portion having a first end adapted to receive a fastener component mounted on the bowstring release, and a second end receiving a slidable and axially adjustable link rod, said barrel portion and said link rod rotatable relative to said release, said link rod having a distal free end adapted for connection to a wrist strap.

Other objects and advantages of the subject invention will become apparent from the detailed description which follows.

BRIEF DESCRIPTION OF THE DRAWINGS

FIG. 6 is a side elevation of a modified wrist strap link for use with the assembly shown in FIG. 1;

FIG. 7 is a plan view of a wrist strap using a modified wrist strap link;

DETAILED DESCRIPTION OF THE DRAWINGS

Figure 1:
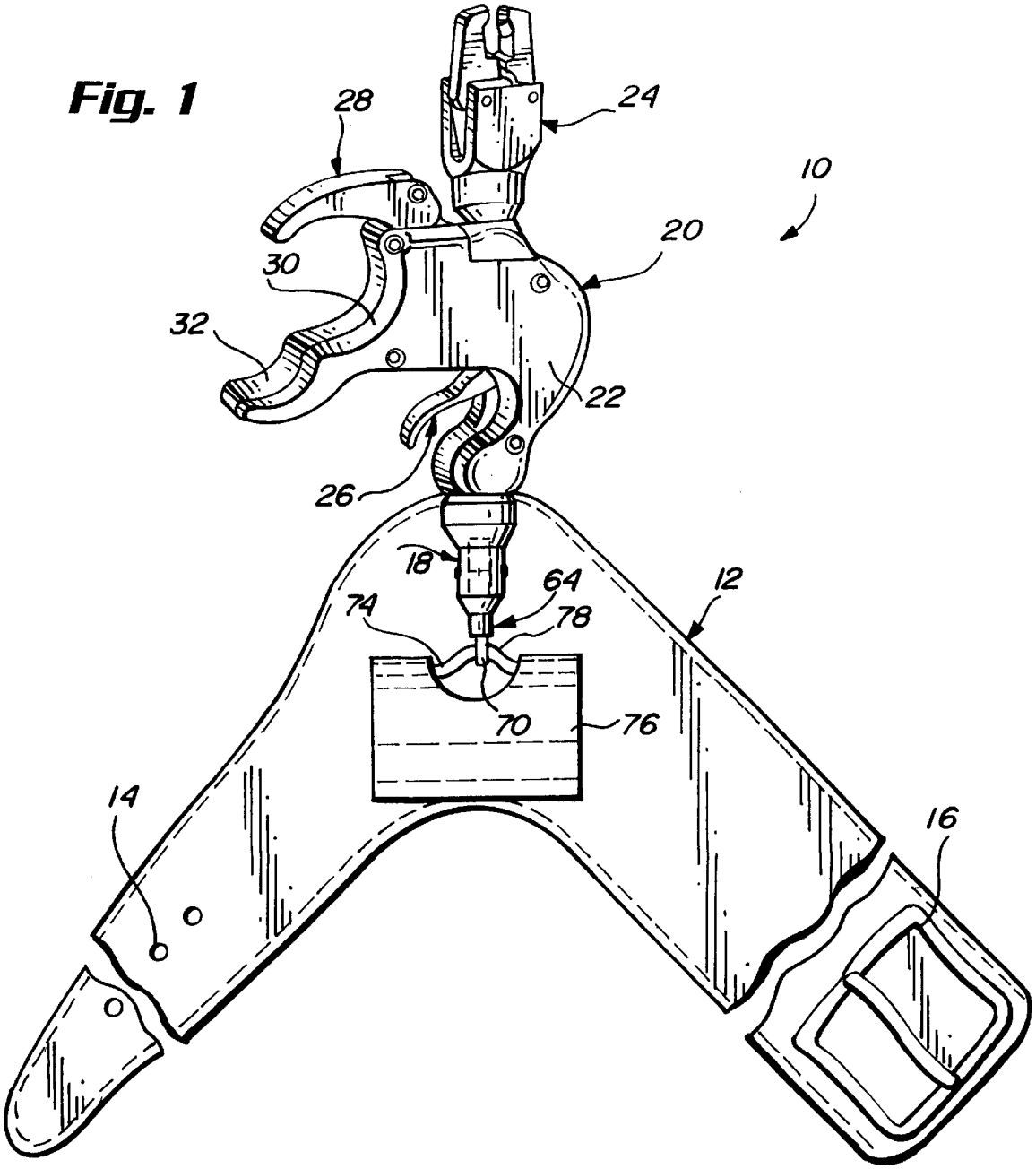
FIG. 1 is a partial perspective view of a wrist strap and wrist strap connector attached to a bowstring release device in accordance with an exemplary embodiment of the invention.

With now reference to FIG. 1, the bowstring release and wrist strap assembly 10 in accordance with one exemplary embodiment includes a wrist strap 12, one end of which is provided with a plurality of buckle receiving holes 14 and an opposite end of which is provided with a conventional buckle mechanism 16. The wrist strap has a generally inverted V-shape with the wrist strap connector 18 secured to the wrist strap at the apex of the inverted V as described in greater detail below. The connector 18 serves to attach the wrist strap to a bowstring release device 20 which may be of the type disclosed in my co-pending application Ser. No. 09-003,181 filed Jan. 5, 1998 (now allowed) entitled "Bowstring Releases", which is incorporated herein by reference. The release illustrated in FIG. 1 includes a handle body 22 which serves as a handgrip. The latter supports a jaw assembly 24 at a forward end thereof. The handle body 22 also supports a combined cocking and hammer bar 26 and a firing trigger mechanism 28. Finger grooves 30, 32 are provided but the number of grooves may be varied. It should be understood, however, that the wrist strap and connector assembly described further herein may be used with other bowstring release devices as well.

Figure 2:
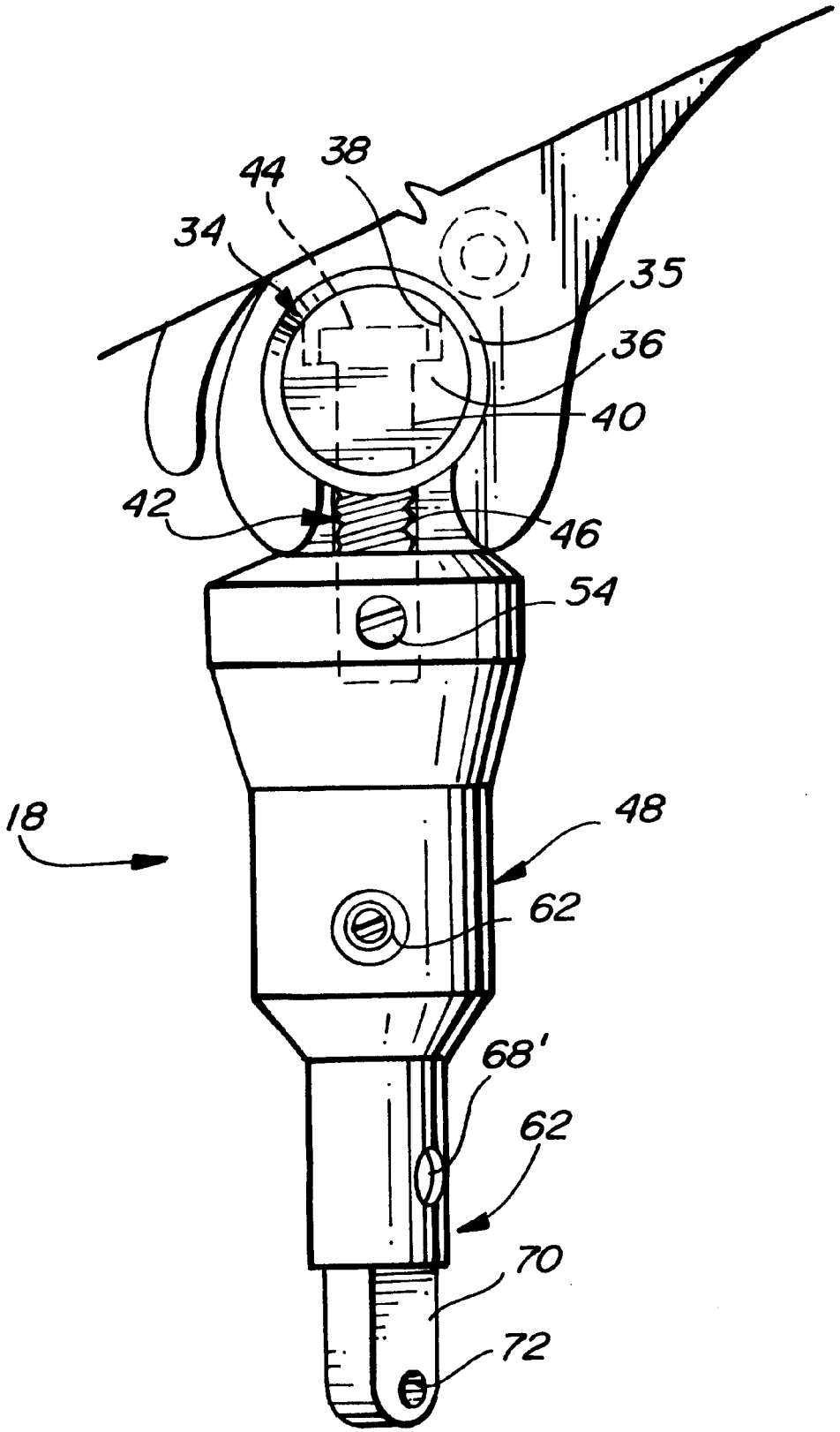
FIG. 2 is an enlarged detail taken from FIG. 1, illustrating the connection between the release device and the connector.

FIG. 2 illustrates in greater detail the manner in which the connector 18 is secured to the release device. Specifically, a disk-like link pin 34 is seated within a cylindrical recess 35 at the rearward end of the release handle body. The link pin 34 comprises a cylindrical member 36 which is counterbored and bored in a transverse direction at 38 and 40, respectively, thereby allowing a screw fastener 42 to be inserted within member 34 with the head 44 of the screw fastener seated within the counterbore and the threaded shank portion 46 extending through the bore 26 and outwardly of the link pin. The arrangement is such that the screw fastener 42 is free to rotate about its own axis within the bore 40 while the link pin 34 is also free to rotate about its own mutually perpendicular axis within the recess 35.

Figure 3:
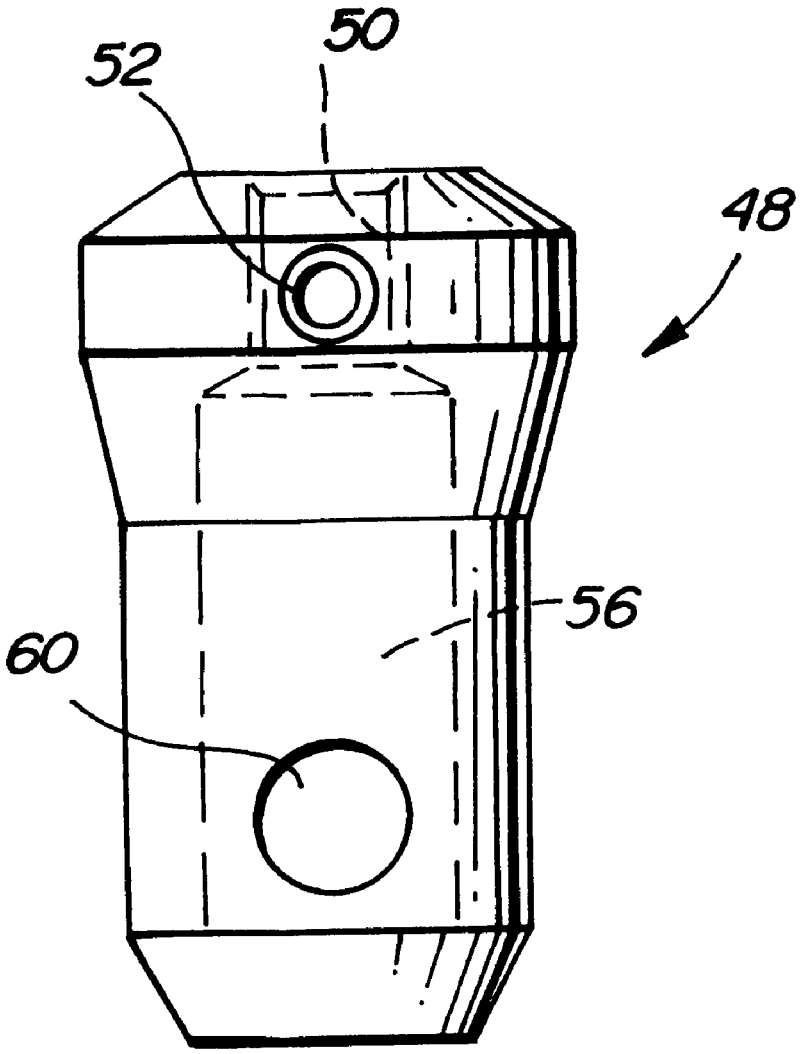
FIG. 3 is a side elevation of a connector barrel component used in the connector assembly in FIGS. 1 and 2.

With reference also to FIG. 3, a barrel connector portion 48 of the connector 18 includes a forward end which is provided with a threaded bore 50 which is adapted to receive the threaded shank 46 of the screw fastener 42. Transversely and oppositely aligned threaded apertures 52 (one shown) intersect the threaded bore 50 so that a respective pair of set screws 54 (one shown) may be threaded into engagement with the shank 46 to thereby firmly secure the connector 18 to the screw fastener 42, while allowing both the screw fastener 42 and barrel portion 48 to rotate about the axis of the fastener relative to the release.

The opposite end of the barrel 48 has a smooth bore 56 which opens at the rearward end of the barrel connector, and a pair of oppositely aligned and threaded apertures 60 (one shown) are transversely aligned and intersect the bore 58. Each aperture receives a set screw 62 (one shown) for a purpose described below.

Figure 4:
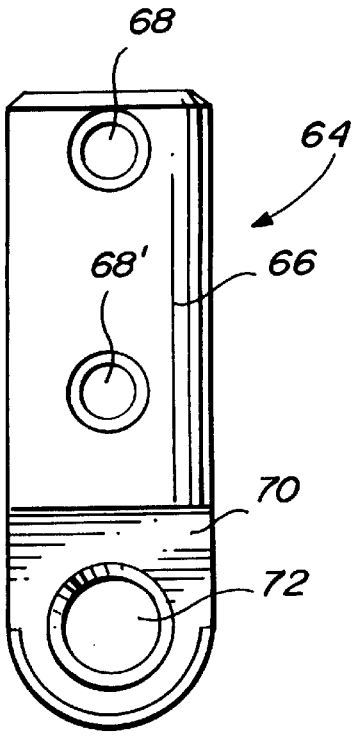
FIG. 4 is a side elevation of an adjustable link rod for use with the barrel connector of FIG. 3.
Figure 5:
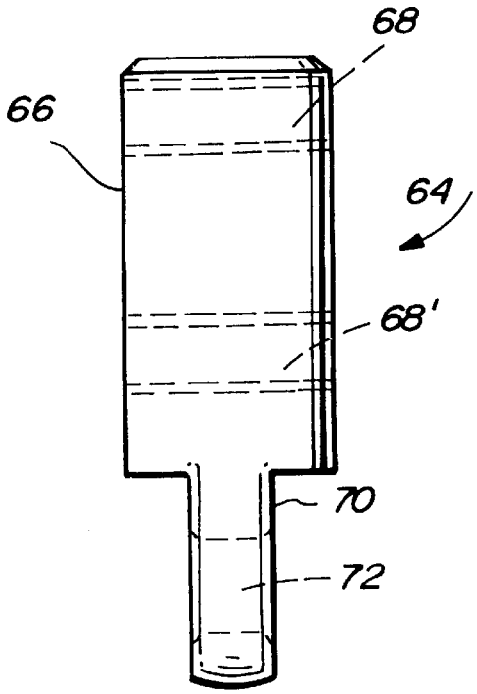
FIG. 5 is an end view of the link rod shown in FIG. 4.

Referring now to FIGS. 4 and 5, an adjustable link rod 64 includes a cylindrical body portion 66 slidable within the bore 58. The cylindrical body portion 66 is provided with a pair of axially spaced, transverse holes 68, 68', one or the other pair of which may be aligned with the transverse holes 60 in the barrel 48. Set screws 62 may then be threaded within the holes 60 and at least partially into the chosen one of holes 68, 68' in the link rod 62, to thereby lock the link rod 64 in the desired axial position relative to the barrel 48. In this way, the link rod is adjustable in telescoping fashion with respect to the barrel portion 48, allowing the archer to adjust the position of the release relative to the wrist strap. It will be appreciated that the length of the rod 62 may be varied, and that additional axially spaced adjustment holes (like those at 68, 68') may be employed to extend the adjustment range of the link.

At the rearward end of the link rod, there is a connection tab or tongue 70 with a transverse hole 72 which extends parallel to the holes 66 and 68. The connecting hole 72 is adapted to receive the wrist strap link 74 (see FIG. 1). The wrist strap link is fixed to the wrist strap by means of a fabric or leather pad 76 sewn to the strap 12. The wrist strap link, or attachment rod, in this first embodiment includes a pin with an offset center portion 78 moved out of the plane of the remaining portions of the pin, projecting out of an opening in the pad seam. In this way, with the strap link sewn in place on the wrist strap, the offset center portion provides a point of attachment for the tab 70 on the link rod 64.

It will be appreciated from FIGS. 1 and 7 that with this arrangement, the connector 18 itself is free to slide back and forth on the offset center portion 74 of the wrist strap link (effectively rotating from side to side), while also being free to rotate toward and away from the wrist strap itself about the axis of the hole 72. When these degrees of rotation are considered along with the previously described degrees of freedom between the connector 18 and the release device 20, it will be appreciated that the connector eliminates any torque between the release device and the connector, while it also allows for complete mobility between the connector and the strap in the sense that the release mechanism is free to lay back on the archer's arm when not in use. It is also noted that the jaw assembly 24 is rotatable relative to the release body as described in the above identified co-pending application Ser. No. 09-003,181, further eliminating any torque on the bowstring.

FIG. 6 illustrates a modification of the wrist strap link 74', where the ends are bent 90° as shown at 80, 82 to ensure that the wrist strap link remains locked within the pad 76.

It will be further appreciated that the buckle type strap illustrated in FIG. 1 provides a consistent draw length for tournament archery, but that a Velcro-type fastening arrangement (not shown) for the wrist strap may be more desirable for hunters.

FIG. 7 illustrates an alternative wrist strap link design which includes a generally triangular shaped link 84 with the two ends 86, 88 forming the base of the triangle, secured to the wrist strap 90 in a manner similar to the earlier described embodiment, utilizing a pad 92 sewn to the wrist strap. In this arrangement, a center loop portion provides even greater freedom of movement for the adjustable link rod as is readily apparent from FIG. 12, noting that the link 84 is also free to rotate within the pad 92.

Figure 8:
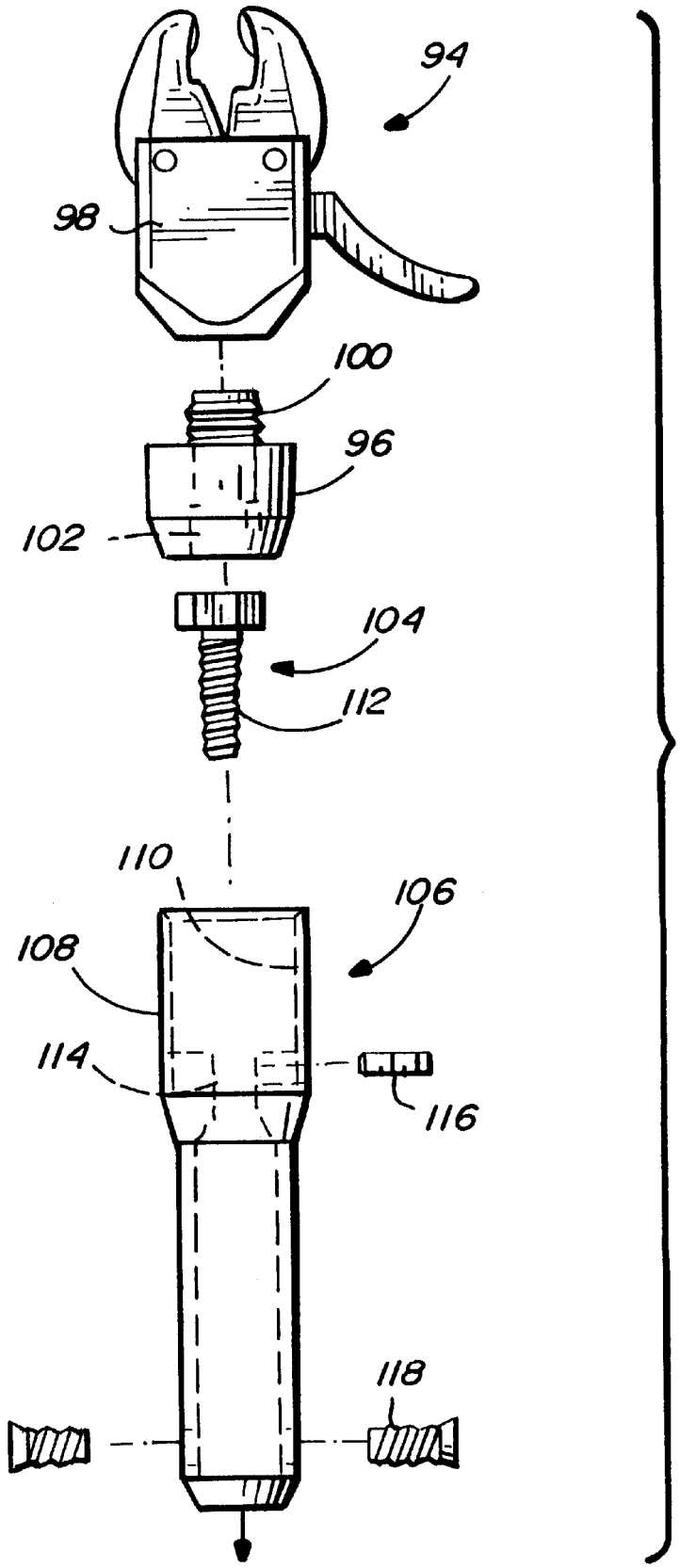
FIG. 8 is an exploded plan view of a wrist strap connector in accordance with a second embodiment of the invention, adapted for use with a different release device.

FIG. 8 illustrates another variation in the connector design, adapted for use with a different release device 94. In this arrangement, an adapter nut 96 is threadedly secured to the rearward end of the jaw assembly 98 via threaded shank 100 extending toward the jaw assembly. The adapter nut is bored and counterbored at 102 so that a swivel connecting screw 104 can be seated in the adapter nut, with the threaded shank 88 extending rearwardly of the nut (similar to the manner in which screw 42 is seated in pin 34). The connector barrel 106 is similar to the connector barrel 48, but an elongated and enlarged forward end 108 is counterbored at 110 to receive the adapter nut 96. The threaded shank 112 of screw 104 is then threaded into a smaller threaded portion 114 of the barrel. The shank 112 can be locked in place by one or more set screws 116 (one shown), as previously described. The barrel otherwise connects to an adjustable link rod in the same way as barrel 48, using set screws 118 to lock the link rod in the desired position as the previously described connector.

Figure 9:
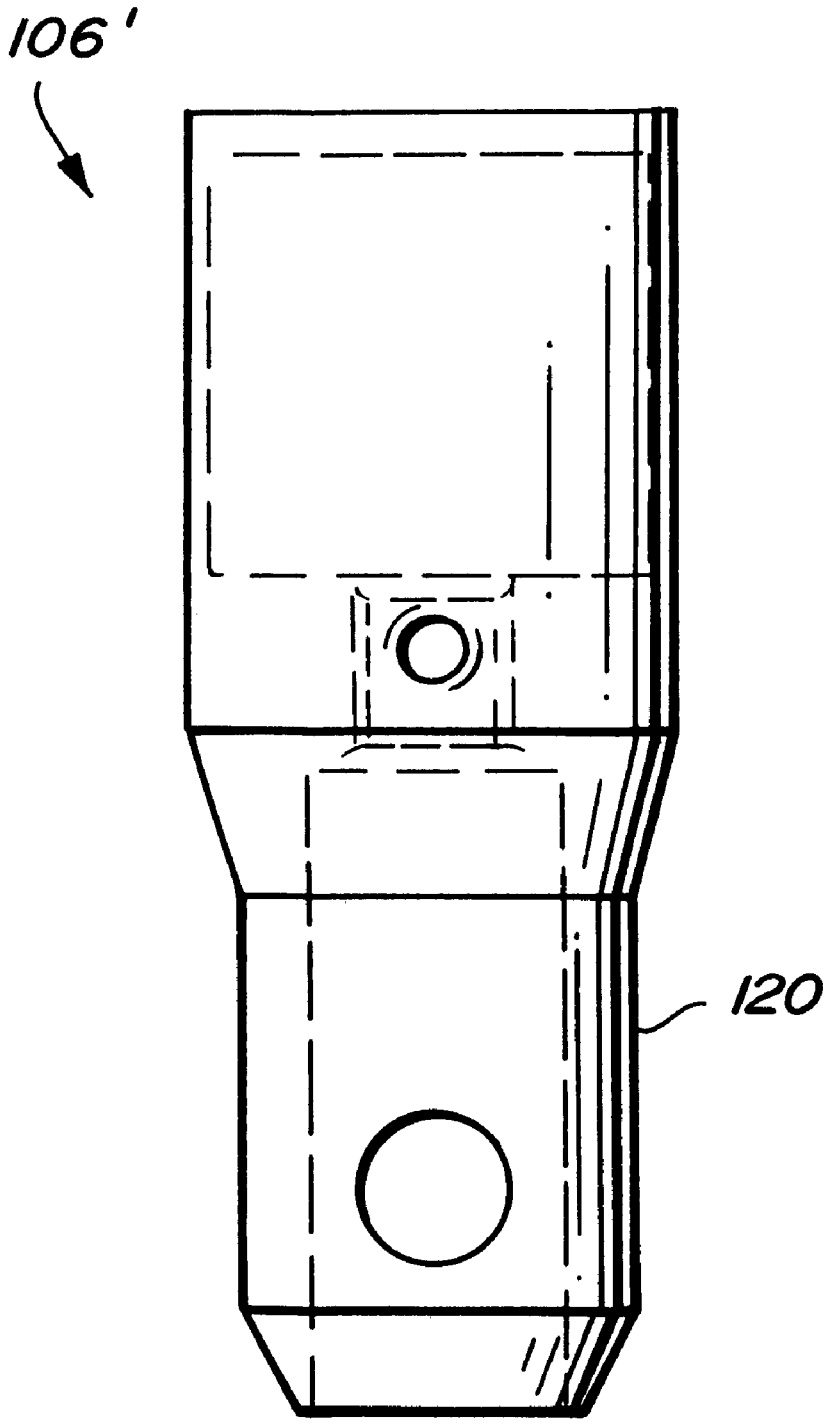
FIG. 9 is a side elevation of a variation of the connector barrel used in FIG. 8.

FIG. 9 is an example of how a connector barrel 106' can be modified to suit particular applications. Here, the lower portion 120 of the barrel is shortened to receive an axially shorter link-rod (not shown). It will be appreciated that other variations relating to, for example, component length, diameter, material selection (aluminum, steel, plastic, etc.), and fastener type are considered within the scope of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A connector for a bowstring release wrist strap comprising:

a barrel portion having a first end adapted to receive a fastener component mounted on the bowstring release, and a second end receiving a slidable and axially adjustable link rod, said barrel portion and said link rod rotatable relative to said release, said link rod having a distal free end adapted for connection to a wrist strap.

2. The connector of claim 1 in combination with a bowstring release device, said release device having a handle body mounting a link pin which supports the fastener component, said fastener component including a shank threadably secured within said first end of said barrel portion.

3. The connector of claim 2 in combination with a wrist strap, said wrist strap having an attachment rod secured thereto, arranged substantially perpendicular to a center, and wherein said attachment rod passes through an attachment hole in said distal free end of said link rod.

4. The connector of claim 2 wherein said fastener component and said barrel portion are rotatable relative to said release device.

5. The connector of claim 2 wherein said barrel portion is adjustable axially relative to said fastener component, and wherein means are provided for locking said barrel portion and said fastener in a desired axial relationship.

6. The connector of claim 5 wherein said barrel portion and said fastener component are rotatable relative to said release device.

7. The connector of claim 6 in combination with a wrist strap, said wrist strap having an attachment rod, and wherein said attachment rod passes through an attachment hole in said distal free end of said link rod.

8. The connector of claim 1 in combination with a wrist strap, said wrist strap having an attachment rod secured thereto, and wherein said attachment rod passes through an attachment hole in said distal free end of said link rod.

9. The connector of claim 8 wherein said attachment rod is fixed to said wrist strap by a fabric web, and wherein said attachment rod comprises an elongated length of metal having an offset center portion, said center portion projecting out of said fabric web.

10. The connector of claim 8 wherein said attachment rod comprises a length of metal bent to form a substantially triangular shape.

11. The connector of claim 1 wherein said link rod and said barrel portion have alignable apertures for receiving at least one locking member for locking said link rod axially relative to said barrel portion.

12. A bowstring release and wrist strap assembly comprising:

a bowstring release including jaws and an associated trigger mechanism; a wrist strap connected to said bowstring release, said wrist strap including a connector extending between said release and said wrist strap, and wherein said connector is rotatable about at least two axes relative to said release and further wherein said connector has multiple degrees of freedom of movement relative to said wrist strap.

13. The assembly of claim 12 wherein said connector is axially adjustable relative to said release.

14. The assembly of claim 13 wherein said connector is axially adjustable relative to said wrist strap.

15. The assembly of claim 12 wherein said connector is axially adjustable relative to said wrist strap.

16. The assembly of claim 12 wherein said connector comprises:

a barrel portion having a first end adapted to receive a fastener component mounted on the bowstring release, and a second end receiving a slidable and axially adjustable link rod, said link rod rotatable relative to said barrel portion and having a distal free end adapted for connection to said wrist strap.

* * * * *